US012167745B2

(12) United States Patent
Hwang et al.

(10) Patent No.: US 12,167,745 B2
(45) Date of Patent: Dec. 17, 2024

(54) CIGARETTE

(71) Applicant: KT&G CORPORATION, Daejeon (KR)

(72) Inventors: Jung Seop Hwang, Daejeon (KR); John Tae Lee, Daejeon (KR); Bong Su Cheong, Daejeon (KR); Sung Jong Ki, Daejeon (KR); Yong Sook Jin, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 632 days.

(21) Appl. No.: 17/050,987

(22) PCT Filed: Jul. 2, 2019

(86) PCT No.: PCT/KR2019/008027
§ 371 (c)(1),
(2) Date: Oct. 27, 2020

(87) PCT Pub. No.: WO2020/009416
PCT Pub. Date: Jan. 9, 2020

(65) Prior Publication Data

US 2021/0227876 A1 Jul. 29, 2021

(30) Foreign Application Priority Data

Jul. 5, 2018 (KR) ..... 10-2018-0078299

(51) Int. Cl.
*A24D 1/04* (2006.01)
*A24D 1/18* (2006.01)
(Continued)

(52) U.S. Cl.
CPC ..... *A24D 1/042* (2013.01); *A24D 1/18* (2013.01); *A24D 1/02* (2013.01); *A24D 3/063* (2013.01)

(58) Field of Classification Search
CPC . A24D 1/042; A24D 1/18; A24D 1/02; A24D 3/063; A24D 3/04; A24D 3/043; A24D 3/062
See application file for complete search history.

(56) References Cited

U.S. PATENT DOCUMENTS 6,907,885 B2 6/2005 Xue et al.
7,552,735 B2 6/2009 Xue et al.
(Continued)

FOREIGN PATENT DOCUMENTS

CN 103763949 A 4/2014
CN 104039183 A 9/2014
(Continued)

OTHER PUBLICATIONS

International Search Report of PCT/KR2019/008027 dated Oct. 11, 2019 [PCT/ISA/210].
(Continued)

*Primary Examiner* — Dionne W. Mayes
(74) *Attorney, Agent, or Firm* — Sughrue Mion, PLLC

(57) ABSTRACT

Disclosed is a cigarette including a tobacco rod, a supporting segment positioned at a downstream end of the tobacco rod, a cooling segment positioned at a downstream end of the supporting segment, and a mouthpiece positioned at a downstream end of the cooling segment.

The cigarette according to the present embodiment may include a plurality of air channels formed along a longitudinal direction of the cigarette and the cooling segment having porosity of 50% or less.

7 Claims, 5 Drawing Sheets

(51) Int. Cl.

| | |
|---|---|
| *A24D 1/02* | (2006.01) |
| *A24D 3/06* | (2006.01) |

(56) References Cited

U.S. PATENT DOCUMENTS

| | | | | |
|---|---|---|---|---|
| 9,185,939 | B2 | 11/2015 | Jarriault et al. | |
| 9,289,013 | B2 * | 3/2016 | Taniguchi et al. | A24D 3/08 |
| 9,894,930 | B2 | 2/2018 | Bonici et al. | |
| 10,609,955 | B2 | 4/2020 | Beard et al. | |
| 2012/0255569 | A1 | 10/2012 | Beard et al. | |
| 2014/0345634 | A1 | 11/2014 | Zuber et al. | |
| 2015/0313281 | A1 * | 11/2015 | Bonici et al. | A24D 1/22 131/330 |
| 2018/0007974 | A1 | 1/2018 | Thorens | |
| 2018/0177228 | A1 | 6/2018 | Pijnenburg et al. | |
| 2018/0177235 | A1 | 6/2018 | Minzoni | |
| 2020/0187555 | A1 | 6/2020 | Lee | |
| 2020/0229488 | A1 * | 7/2020 | Prestia et al. | A24D 1/02 |

FOREIGN PATENT DOCUMENTS

| | | | |
|---|---|---|---|
| CN | 104270970 | A | 1/2015 |
| CN | 105072937 | A | 11/2015 |
| CN | 108113051 | A | 6/2018 |
| EP | 2 625 974 | A1 | 8/2013 |
| EP | 2 625 975 | A1 | 8/2013 |
| EP | 3 494 809 | B1 | 2/2021 |
| JP | 2005-522207 | A | 7/2005 |
| KR | 10-0759176 | B1 | 9/2007 |
| KR | 1020140009385 | A | 1/2014 |
| KR | 10-2015-0132111 | A | 11/2015 |
| KR | 10-2018-0070512 | A | 6/2020 |
| WO | 2012123702 | A1 | 9/2012 |
| WO | 2013/098405 | A2 | 7/2013 |
| WO | 2015/082651 | A1 | 6/2015 |
| WO | 2017/144861 | A1 | 8/2017 |

OTHER PUBLICATIONS

Written Opinion of PCT/KR2019/008027 dated Oct. 11, 2019 [PCT/ISA/237].

Communication dated Mar. 29, 2021, from the Korean Intellectual Property Office in application No. 10-2018-0078299.

Notification of Reason for Refusal dated Oct. 27, 2021 from the Korean Patent Office in Korean Application No. 10-2018-0078299.

Extended European Search Report dated Dec. 7, 2021 in European Application No. 19830240.8.

Notice of Reasons for Refusal dated Oct. 12, 2021 from the Japanese Patent Office in Japanese Application No. 2020-556934.

Office Action issued Dec. 27, 2021 in Chinese Application No. 201980028979.4.

* cited by examiner

CIGARETTE

TECHNICAL FIELD

The present disclosure provides a cigarette including a tobacco rod and a filter rod.

BACKGROUND ART

Recently, demand for alternative methods of overcoming shortcomings of traditional cigarettes has increased. For example, there is growing demand for a method of generating an aerosol by heating an aerosol generating material in cigarettes, rather than by combusting cigarettes.

A cigarette includes a filter which serves to filter specific components contained in an aerosol or to cool the aerosol. If filtering performance of a filter is too high, the amount of aerosol migration may be reduced. On the other hand, if the filtering performance is too low, specific components included in an aerosol may not be properly filtered.

Accordingly, research has been conducted to develop a filter having an appropriate performance by changing the components configuring a filter or by changing a structure of the filter.

DESCRIPTION OF EMBODIMENTS

Technical Problem

The present disclosure provides a cigarette including a plurality of air channels formed along a longitudinal direction of the cigarette, and a cooling segment having porosity of 50% or less. Technical problems to be solved by the present embodiments are not limited to the technical problems described above, and other technical problems may be inferred from the following embodiments.

Solution to Problem

Disclosed in a cigarette including a tobacco rod, a supporting segment positioned at a downstream end of the tobacco rod, a cooling segment positioned at a downstream end of the supporting segment, and a mouthpiece positioned at a downstream end of the cooling segment.

The cigarette according to the present embodiment may include a plurality of air channels formed along a longitudinal direction of the cigarette and the cooling segment having porosity of 50% or less.

Advantageous Effects of Disclosure

According to the present disclosure, there is provided a cigarette including a cooling segment that includes a bundle of straight fibers arranged along a longitudinal direction of a cigarette, a bundle of crimped fibers arranged to form a wrinkle along the longitudinal direction of the cigarette, or a combination thereof, and thus, a cooling efficiency may be improved.

BEST MODE

A cigarette includes a tobacco rod; a supporting segment positioned at a downstream end of the tobacco rod; a cooling segment positioned at a downstream end of the supporting segment; and a mouthpiece positioned at a downstream end of the cooling segment, wherein the cooling segment includes a plurality of air channels formed along a longitudinal direction of the cigarette, and the cooling segment has porosity of 50% or less.

Mode of Disclosure

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in a certain case, some terms may be randomly selected by the applicant, and in this case, meaning thereof will be described in detail in description of the corresponding disclosure. Therefore, the terms used in the present disclosure should be defined based on the meanings of the terms and the content of the present disclosure, not by the names of the terms.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

In the following embodiments, the term "upstream" indicates the part where external air flows into a cigarette when a user inhales air by using the cigarette, and the term "downstream" indicates the part where air in the cigarette flows out to the outside when a user inhales on the cigarette. The terms "upstream" and "downstream" are used to indicate a relative position between segments configuring a cigarette. When using a cigarette, a user may bite a downstream end of the cigarette. Furthermore, the term "end portion" may be described as "end".

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

Figure 1:
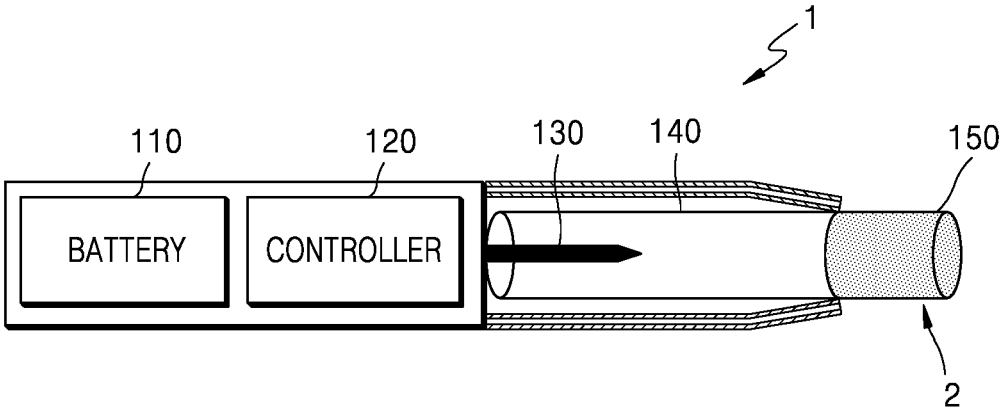
FIG. 1 is a view illustrating an example in which a cigarette is inserted into a holder.

FIG. 1 is a view illustrating an example in which a cigarette is inserted into a holder.

Referring to FIG. 1, a cigarette 2 may be inserted into a holder 1. When the cigarette 2 is inserted, a heater 130 is positioned inside the cigarette 2. Accordingly, an aerosol generating material of the cigarette 2 is heated by the heated heater 130, and thus, an aerosol is generated.

The cigarette 2 may have a shape similar to a general combustion type cigarette. For example, the cigarette 2 may be divided into a first portion 140 including an aerosol generating material and a second portion 150 including a filter, and so on.

The entire first portion 140 may be inserted into the holder 1, and the second portion 150 may be exposed to the outside. Alternatively, only a part of the first portion 140 may be inserted into the holder 1. Otherwise, the entire first portion 140 and a part of the second portion 150 may be inserted into the holder 1.

A user may inhale an aerosol while biting the second portion 150. As such, the aerosol is generated as external air passes through the first portion 140, and the generated aerosol passes through the second portion 150 to be delivered to the mouth of the user.

The external air may be introduced through at least one air passage formed in the holder 1. Also, the external air may be introduced through at least one hole formed in a surface of the cigarette 2.

Figure 2:
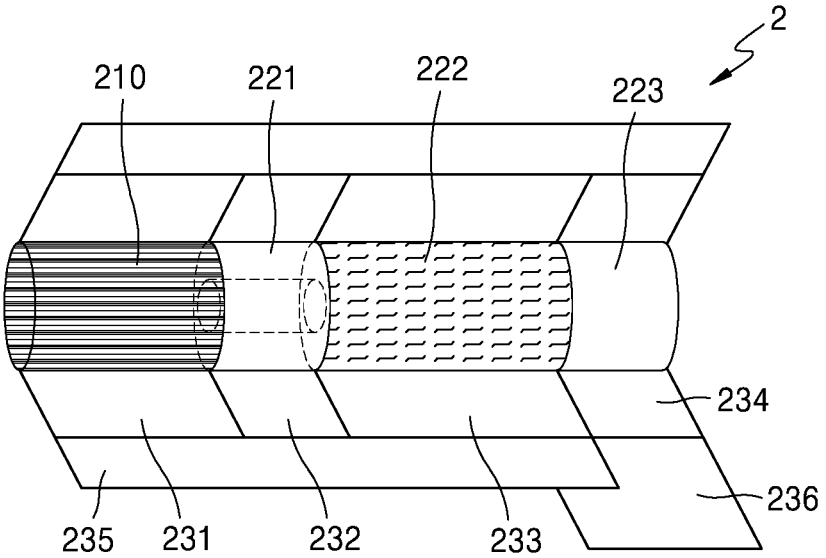
FIG. 2 is a configuration diagram illustrating an example of a cigarette.

FIG. 2 is a configuration diagram illustrating an example of a cigarette.

Referring to FIG. 2, the cigarette 2 includes a tobacco rod 210, a first filter segment 221, a cooling structure 222, and a second filter segment 223. The first portion described above with reference to FIG. 1 may include the tobacco rod 210, and the second portion may include the first filter segment 221, the cooling structure 222, and the second filter segment 223.

Referring to FIG. 2, the cigarette 2 may be wrapped by wrappers 231, 232, 233, 234, 235, and 236. For example, the tobacco rod 210 is wrapped by the first wrapper 231, and the first filter segment 221 is wrapped by the second wrapper 232. In addition, the cooling structure 222 is wrapped by the third wrapper 233, and the second filter segment 223 is wrapped by the fourth wrapper 234.

The fifth wrapper 235 may enclose the first wrapper 231, the second wrapper 232, and the third wrapper 233. In other words, the tobacco rod 210, the first filter segment 221, and the cooling structure 222 of the cigarette 2 may be further wrapped by the fifth wrapper 235. In addition, the sixth wrapper 236 may enclose at least a part of the fifth wrapper 235 and the fourth wrapper 234. In other words, at least a part of the cooling structure 222 and the second filter segment 223 of the cigarette 2 may be further wrapped by the sixth wrapper 236.

The first wrapper 231, the second wrapper 232, the fifth wrapper 235, and the sixth wrapper 236 may be made of general plug wrap paper. For example, the first wrapper 231, the second wrapper 232, the fifth wrapper 235, and the sixth wrapper 236 may be made of porous wrapping paper or non-porous wrapping paper. For example, a thickness of the first wrapper 231 may be approximately 61 m, porosity thereof may be approximately 15 CU, a thickness of the second wrapper 232 may be approximately 63 m, and porosity thereof may be approximately 15 CU, but are not limited thereto. In addition, a thickness of the fifth wrapper 235 may be approximately 66 m, porosity thereof may be approximately 10 CU, a thickness of the sixth wrapper 236 may be 66 m, and porosity thereof may be approximately 17 CU, but embodiments are not limited thereto.

In addition, an aluminum foil may be further provided on inner surfaces of the first wrapper 231 and/or the second wrapper 232.

The third wrapper 233 and the fourth wrapper 234 may be made of hard wrapping paper. For example, a thickness of the third wrapper 233 may be approximately 158 m, porosity thereof may be approximately 33 CU, a thickness of the fourth wrapper 234 may be approximately 155 m, and porosity thereof may be approximately 46 CU, but embodiments are not limited thereto.

A predetermined material may be added to the fifth wrapper 235 and the sixth wrapper 236. Here, for example, the predetermined material may be silicon, but is not limited thereto. For example, silicone has characteristics such as heat resistance, oxidation resistance, resistance to various chemicals, repellency to water, and electrical insulation. However, the fifth wrapper 235 and the sixth wrapper 236 may be coated (applied) with any other material without limitation as long as the material has the above-described characteristics.

The fifth wrapper 235 and the sixth wrapper 236 may prevent the cigarette 2 from burning. For example, when the tobacco rod 210 is heated by the heater 130, there is a possibility that the cigarette 2 is burned. Specifically, when a temperature rises above an ignition point of any one of materials included in the tobacco rod 210, the cigarette 2 may be burned. Even in this case, the fifth wrapper 235 and the sixth wrapper 236 include a non-combustible material, and thus, the cigarette 2 may be prevented from burning.

In addition, the fifth wrapper 235 may prevent the holder 1 from being contaminated by a material generated in the cigarette 2. Liquid materials may be generated in the cigarette 2 by puff of a user. For example, as the aerosol generated in the cigarette 2 is cooled by external air, liquid materials (for example, moisture, and so on) may be generated. As the fifth wrapper 235 wraps the tobacco rod 210 and/or the first filter segment 221, the liquid materials generated in the cigarette 2 may be prevented from leaking out of the cigarette 2. Therefore, the inside of the holder 1 may be prevented from being contaminated by the liquid materials generated in the cigarette 2.

A diameter of the cigarette 2 may be within a range of 5 mm to 9 mm, and a length thereof may be approximately 48 mm, but embodiments are not limited thereto. For example, a length of the tobacco rod 210 may be approximately 12 mm, a length of the first filter segment 221 may be approximately 10 mm, a length of the cooling structure 222 may be approximately 14 mm, and a length of the second filter segment 223 may be approximately 12 mm. However, embodiments are not limited thereto.

The structure of the cigarette 2 illustrated in FIG. 2 is only an example, and a part of the components may be omitted. For example, one or more of the first filter segment 221, the cooling structure 222, and the second filter segment 223 may not be included in the cigarette 2.

The tobacco rod 210 includes an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol.

In addition, the tobacco rod 210 may include other additives, such as a flavoring agent, a wetting agent, and/or organic acid. For example, the flavoring agents may include licorice, sucrose, fructose syrup, isosweet, cocoa, lavender, cinnamon, cardamom, celery, fenugreek, cascarilla, sandalwood, bergamot, geranium, honey essence, rose oil, vanilla, lemon oil, orange oil, mint oil, cinnamon, caraway, cognac, jasmine, chamomile, menthol, cinnamon, ylang-ylang, sage, spearmint, ginger, coriander, or coffee. In addition, the wetting agent may include glycerin or propylene glycol.

As an example, the tobacco rod 210 may be filled with a reconstituted tobacco sheet.

As another example, the tobacco rod 210 may be filled with cut tobacco. Here, the cut tobacco may be made by shredding a reconstituted tobacco sheet.

As another example, the tobacco rod 310 may be filled with a plurality of tobacco strands obtained by finely cutting a reconstituted tobacco sheet. For example, the tobacco rod 310 may be formed by a plurality of tobacco strands arranged in the same direction (in parallel to one another) or randomly.

For example, the reconstituted tobacco sheet may be made through the following process. First, a tobacco raw material is crushed to make slurry in which aerosol generating materials (for example, glycerin, propylene glycol, and so on), a flavored liquid, binder (for example, guar gum, xanthan gum, carboxymethyl cellulose (CMC), and so on), water, and so on are mixed, and the reconstituted tobacco sheet is formed by using the slurry. When making the slurry, natural pulp or cellulose may be added, and one or more binders may be mixed. Furthermore, tobacco strands may be obtained by cutting or finely cutting the dried reconstituted tobacco sheet.

The tobacco raw material may be tobacco leaf flakes, tobacco stems, and/or fine tobacco powder generated during tobacco processing. In addition, other additives such as wood cellulose fiber may be contained in the reconstituted tobacco sheet.

An aerosol generating material of 5% to 40% may be added to the slurry, and an aerosol generating material of 2% to 35% may remain on the reconstituted tobacco sheet. Preferably, an aerosol generating material of 5% to 30% may remain in the reconstituted tobacco sheet.

In addition, before a process in which the tobacco rod 210 is wrapped by the first wrapper 231, a flavored liquid such as menthol or moisturizer may be sprayed on the center of the tobacco rod 210 to be added.

The first filter segment 221 may be a cellulose acetate filter. For example, the first filter segment 221 may be a tube-shaped structure including a hollow therein. A length of the first filter segment 221 may be appropriately selected within a range of 4 mm to 30 mm, but is not limited thereto. Preferably, the length of the first filter segment 221 may be 10 mm, but is not limited thereto.

A diameter of the hollow formed in the first filter segment 221 may be appropriately selected within a range of 2 mm to 4.5 mm, but is not limited thereto.

Hardness of the first filter segment 221 may be adjusted by adjusting content of a plasticizer when making the first filter segment 221.

In addition, the first filter segment 221 may be made by inserting a structure such as a film or a tube of the same material or different materials therein (for example, in a hollow).

The first filter segment 221 may be made by using cellulose acetate. Accordingly, when the heater 130 is inserted, a phenomenon in which an internal material of the tobacco rod 210 is pushed back may also be prevented, and a cooling effect of an aerosol may be generated.

The cooling structure 222 cools an aerosol generated by heating the tobacco rod 210 with the heater 130. Therefore, a user may inhale the aerosol cooled to an appropriate temperature.

A length or a diameter of the cooling structure 222 may be variously determined according to a shape of the cigarette 2. For example, a length of the cooling structure 222 may be appropriately selected within a range of 7 mm to 20 mm. Preferably, the length of the cooling structure 222 may be 14 mm, but is not limited thereto.

The cooling structure 222 may be made by weaving polymer fiber. In this case, the fiber made of a polymer may be coated with a flavored liquid. Alternatively, the cooling structure 222 may also be made by weaving fiber coated with a flavored liquid and fiber made of a polymer.

Alternatively, the cooling structure 222 may be formed of a crimped polymer sheet.

The polymer is made of a material selected from a group consisting of polyethylene (PE), polypropylene (PP), polyvinyl chloride (PVC), polyethylene terephthalate (PET), polylactic acid (PLA), cellulose acetate (CA), and aluminum foil.

Since the cooling structure 222 is formed of woven polymer fiber or a crimped polymer sheet, the cooling structure 222 may include single or multiple channels extending in a longitudinal direction. Here, the channel indicates a passage through which gas (for example, air or aerosol) passes.

For example, the cooling structure 222 made of a crimped polymer sheet may be formed of a material having a thickness between approximately 5 m and approximately 300 m, for example between approximately 10 m and approximately 250 m. In addition, a total surface area of the cooling structure 222 may be between approximately 300 $mm^2/mm$ and approximately 1000 $mm^2/mm$. In addition, an aerosol cooling element may be formed of a material having a specific surface area between approximately 10 $mm^2/mg$ and approximately 100 $mm^2/mg$.

Furthermore, the cooling structure 222 may include a thread containing a volatile flavor component. Here, the volatile flavor component may be menthol, but is not limited thereto. For example, the thread may be filled with the sufficient amount of menthol to provide menthol of 1.5 mg or more to the cooling structure 222.

The second filter segment 223 may be a cellulose acetate filter. A length of the second filter segment 223 may be appropriately selected within a range of 4 mm to 20 mm. For example, the length of the second filter segment 223 may be approximately 12 mm, but is not limited thereto.

In a process of making the second filter segment 223, a flavored liquid may be sprayed to the second filter segment 223 such that the second filter segment 223 provides flavor. Alternatively, separate fiber coated with a flavored liquid may be inserted into the second filter segment 223. Aerosol generated in the tobacco rod 210 is cooled while passing through the cooling structure 222, and the cooled aerosol is delivered to a user through the second filter segment 223. Therefore, when a flavoring element is added to the second filter segment 223, persistence of flavor delivered to a user may be enhanced.

Figure 3:
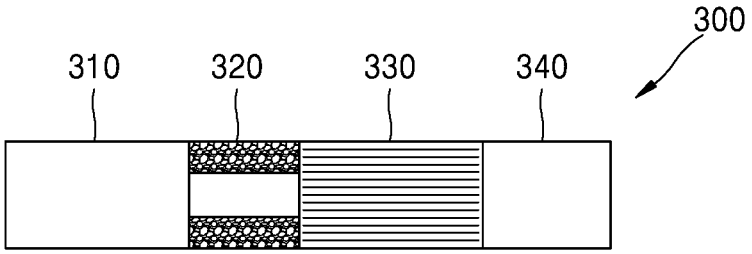
FIG. 3 is a cross-sectional view of a cigarette including a cooling segment composed of a bundle of fibers according to an embodiment.

FIG. 3 is a cross-sectional view of a cigarette including a cooling segment composed of a bundle of fibers according to an embodiment.

Referring to FIG. 3, the cigarette 300 may include a tobacco rod 310, a supporting segment 320, a cooling segment 330, and a mouthpiece 340. However, this is only an example. Thus, the cigarette 300 may include other elements in addition to the elements 310 to 340 illustrated in FIG. 3, or some of the elements 310 to 340 illustrated in FIG. 3 may be omitted.

In an embodiment, the supporting segment 320 may be positioned at a downstream end of the tobacco rod 310, the cooling segment 330 may be positioned at a downstream end of the supporting segment 320, and the mouthpiece 340 may be positioned at a downstream end of the cooling segment 330. However, an arrangement structure of a plurality of segments of the cigarette 300 is not limited thereto.

The tobacco rod 310 may be made of a sheet or strands. In addition, the tobacco rod 310 may also be made of tobacco fragments obtained by finely cutting a tobacco sheet. The tobacco rod 310 may have a cylindrical shape, and smoke and/or an aerosol may be generated as the tobacco rod 310 is heated.

The tobacco rod 310 may include an aerosol generating material, additives such as a flavoring agent, a wetting agent, and/or organic acid, and a flavored liquid such as menthol or a moisturizing agent, but embodiments are not limited thereto. In an embodiment, the tobacco rod 310 may include a wetting agent of 15% or more.

The supporting segment 320 may be a cellulose acetate filter. For example, the supporting segment 320 may be a tube-shaped structure including a hollow therein. A length of the supporting segment 320 may be appropriately selected within a range of 4 mm to 30 mm, but is not limited thereto. Preferably, the length of the supporting segment 320 may be 10 mm, but is not limited thereto.

A diameter of the hollow formed in the supporting segment 320 may be appropriately selected within a range of 3 mm to 4.5 mm, but is not limited thereto. Hardness of the supporting segment 320 may be adjusted in the manufacturing process by adjusting content of a plasticizer.

In order to prevent a size of the supporting segment 320 from decreasing over time, an outer surface of the supporting segment 320 may be wrapped by a wrapper. Accordingly, the supporting segment 320 may be easily combined with another element.

In addition, the supporting segment 320 may be made by inserting a structure such as a film or a tube made of a material identical to or different from the supporting segment 320 into the interior (for example, in a hollow).

The cooling segment 330 may cool an aerosol which is generated as a heater heats the tobacco rod 310. Therefore, a user may inhale the aerosol cooled to an appropriate temperature when smoking the cigarette 300.

A length or a diameter of the cooling segment 330 may be variously determined according to a shape of the cigarette 300. For example, the length of the cooling segment 330 may be appropriately selected within a range of 5 mm to 30 mm. Preferably, the length of the cooling segment 330 may be appropriately selected within a range of 5 mm to 20 mm. For example, the length of the cooling segment 330 may be approximately 14 mm, but is not limited thereto.

The cooling segment 330 may be made of a polymer material (or a polymer) selected from polyethylene, polypropylene, polyvinyl chloride, polyethylene terephthalate, polylactic acid, and cellulose acetate. In one embodiment, the cooling segment 330 may be made of pure polylactic acid or a combination of other degradable polymers and polylactic acid.

The cooling segment 330 may be made through an extrusion method or a textile weaving method. The cooling segment 330 may be made in various forms to increase a surface area (that is, a surface area in contact with aerosol) per unit area.

In an embodiment, the cooling segment 330 may include a bundle of fibers in which fibers of a polymer material (for example, polylactic acid) are uniformly dispersed. As illustrated in FIG. 3, the bundle of fibers of the polymer material may be arranged along the longitudinal direction of the cigarette 300 to form a plurality of air channels. Aerosol generated as the tobacco rod 310 is heated passes through the supporting segment 320 to reach the cooling segment 330. Then, the aerosol passes through the plurality of air channels formed between the fibers of the cooling segment 330 to reach the mouthpiece 340.

Porosity of the cooling segments 330 including a bundle of fibers arranged along the longitudinal direction of the cigarette 300 may be 50% or less. Preferably, the porosity of the cooling segment 330 may be 20 to 50%. As the cooling segment 330 including the bundle of fibers has porosity of 50% or less, a contact time and a contact area between the aerosol and the bundle of fibers may increase. That is, a cooling efficiency of the cooling segment 330 may be improved. In addition, the cooling segment 330 having porosity of 50% or less has an appropriate draw resistance. As such, it is possible to prevent user's unsatisfactory puffing on the cigarette 300 due to low draw resistance.

A bundle of fibers of a polymer material included in the cooling segment 330 may be coated with a flavored liquid. In one embodiment, the cooling segment 330 may be made by using separate fiber coated with a flavoring liquid and fiber made of a polymer material.

The mouthpiece 340 may be a cellulose acetate filter. For example, the mouthpiece 340 may be made of a recess filter, but is not limited thereto. A length of the mouthpiece 340 may be appropriately selected within a range of 4 mm to 30 mm. For example, the length of the mouthpiece 340 may be approximately 12 mm, but is not limited thereto.

In a manufacturing process of the mouthpiece 340, a flavored liquid may be sprayed to the mouthpiece 340 so that the mouthpiece 340 provides a flavor. Alternatively, separate fiber coated with a flavored liquid may be inserted into the mouthpiece 340. The aerosol generated as the tobacco rod 310 is heated may be cooled while passing through the cooling segment 330, and then it may be delivered to a user through the mouthpiece 340. Therefore, when a flavored element is added to the mouthpiece 340, persistence of flavor delivered to a user may be improved. In addition, the mouthpiece 340 may include at least one capsule. Here, the capsule may have a structure in which a content liquid containing fragrance is wrapped with a film. For example, the capsule may have a spherical or cylindrical shape.

In one embodiment, the tobacco rod 310, the supporting segment 320, the cooling segment 330, and the mouthpiece 340 may be wrapped by separate wrappers, respectively. In addition, the entire the cigarette 300 may be double-wrapped by another wrapper enclosing the wrapper wrapping each of the tobacco rod 310, the supporting segment 320, the cooling segment 330, and the mouthpiece 340. However, a method of wrapping the cigarette 300 and its portions with a wrapper is not limited thereto.

Figure 4A:
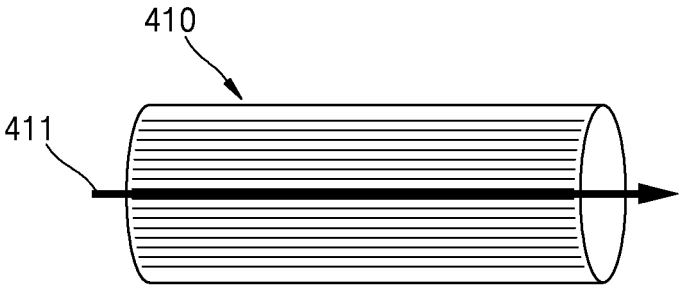
FIGS. 4A to 4C are views illustrating a cooling segment according to an embodiment.
Figure 4B:
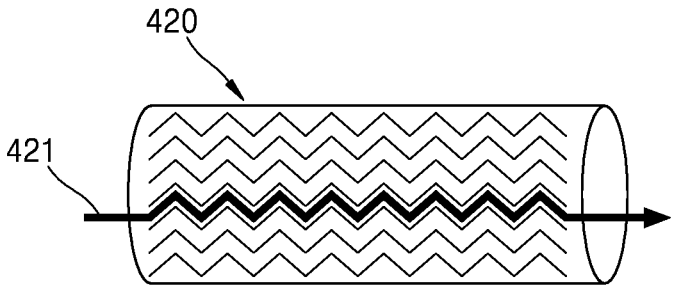
Figure 4C:
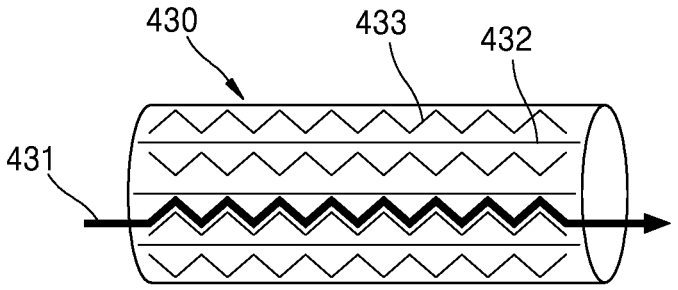

FIGS. 4A to 4C are views illustrating a cooling segment according to an embodiment.

Referring to FIG. 4A, the cooling segment 410 may include a bundle of fibers in which fibers of a polymer material are uniformly dispersed. The bundle of fibers included in the cooling segment 410 may be arranged along a longitudinal direction of the cigarette to form a plurality of air channels 411.

Referring to FIG. 4B, the cooling segment 410 may include a bundle of fibers in which fibers of a polymer material are uniformly dispersed. A bundle of fibers included in the cooling segment 420 may be crimped to form wrinkles along a longitudinal direction of the cigarette. As such, a plurality of air channels 421 may be formed.

Referring to FIG. 4C, the cooling segment 430 may include a bundle of fibers of a polymer material. The bundle of fibers may be composed of a plurality of straight fibers 432 and a plurality of crimped fibers 433. The bundle of fibers may be arranged along the longitudinal direction of the cigarette to form a plurality of air channels 431.

A wrinkle interval between the crimped fibers in FIGS. 4B and 4C may be constant. Alternatively, the bundle of fibers may be crimped irregularly.

In an embodiment, the cooling segments 410, 420, and 430 may be wrapped by wrappers having a high basis weight. For example, the cooling segment 410, 420, or 430 may be wrapped by a wrapper having a basis weight of 60 $g/m^2$ or more, but the basis weight of the wrapper wrapping the cooling segment 410, 420, or 430 is not limited thereto. The cooling segments 410, 420, and 430 may be wrapped by wrappers having a high basis weight to maintain hardness of the cooling segments 410, 420, and 430 which include a bundle of straight fibers arranged along a longitudinal direction of a cigarette, a bundle of crimped fibers arranged to form a wrinkle along the longitudinal direction of the cigarette, or a combination thereof.

The cooling segments 410, 420, and 430 of FIGS. 4A-4C include the plurality of air channels 411, 421, and 431 formed along a longitudinal direction of a cigarette and may have porosity of 50% or less. As the cooling segments 410, 420, and 430 have porosity of 50% or less, a contact time and a contact area between an aerosol and a bundle of fibers may be increased. That is, cooling efficiencies of the cooling segments 410, 420, and 430 may be improved. In addition, as the cooling segments 410, 420, and 430 having porosity of 50% or less have an appropriate draw resistance. As such, it is possible to prevent user's puff failure due to a low draw resistance of the cigarette.

FIGS. 5A to 5D are views illustrating temperatures of portions of a cooling segment according to an embodiment.

Hereinafter, description overlapping the description of FIG. 3 will be omitted for convenience.

The aerosol generated as tobacco rods 510*a* to 510*d* are heated passes through supporting segments 520*a* to 520*d* to reach cooling segments 530*a* to 530*d*. The aerosol is cooled while passing through the cooling segments 530*a* to 530*d*, and it may be delivered to a user through the mouthpieces 540*a* to 540*d*.

A temperature of an aerosol before passing through the cooling segments 530*a* to 530*d* may be measured by measuring temperatures of first portions 531*a* to 531*d* where the supporting segments 520*a* to 520*d* contact the cooling segments 530*a* to 530*d*. Also, a temperature of an aerosol after passing through the cooling segments 530*a* to 530*d* may be measured by measuring temperatures of second portions 532*a* to 532*d* where the cooling segments 530*a* to 530*d* contact the mouthpieces 540*a* to 540*d*. In one embodiment, the temperature of the aerosol passing through the first portion 531*a* to 531*d* and the second portion 532*a* to 532*d* may be measured by using a contact-type temperature sensor, but a temperature measuring method is not limited thereto.

The temperature of the aerosol passing through the first portions 531*a* to 531*d* may be approximately 150° C. to 160° C.

In an embodiment, the cooling segment 530*a* may include a single corrugated sheet or multiple corrugated sheets of a polymeric material. Porosity of the cooling segment 530*a* may be 50% to 90%. In this case, the temperature of the aerosol passing through the second portion 532*a* may be approximately 60° C. to 65° C.

In an embodiment, the cooling segment 530*b* may include a bundle of fibers in which fibers of a polymer material are uniformly dispersed. The bundle of fibers included in the cooling segment 530*b* may be arranged along a longitudinal direction of a cigarette to form a plurality of air channels. Porosity of the cooling segment 530*b* may be 50% or less. In this case, the temperature of the aerosol passing through the second portion 532*b* may be approximately 50° C. to 55° C. That is, the cooling segment 530*b* in FIG. 5B is composed of a bundle of fibers, and thus, a contact time and a contact area between the aerosol and the bundle of fibers are increased, thereby improving a cooling efficiency, compared with the cooling segment 530*a* of FIG. 5A.

In an embodiment, the cooling segment 530*c* may include a bundle of fibers in which fibers of a polymer material are uniformly dispersed. The bundle of fibers included in the cooling segment 530*c* may be crimped to form wrinkles along a longitudinal direction of a cigarette, thereby forming a plurality of air channels. Porosity of the cooling segment 530*c* may be 50% or less. In this case, the temperature of the aerosol passing through the second portion 532*c* may be approximately 40° C. to 45° C. That is, the cooling segment 530*c* in FIG. 5C is composed of a bundle of crimped fibers, and thus, a contact time and a contact area between the aerosol and the bundle of crimped fibers are increased, thereby improving a cooling efficiency, compared with the cooling segment 530*a* of FIG. 5A.

In an embodiment, the cooling segment 530*d* may include a bundle of fibers of a polymeric material. The bundle of fibers may be composed of a plurality of straight fibers and a plurality of crimped fibers. The bundle of fibers may be arranged along a longitudinal direction of a cigarette, thereby forming a plurality of air channels. Porosity of the cooling segment 530*d* may be 50% or less. In this case, the temperature of the aerosol passing through the second portion 532*d* may be approximately 45° C. to 50° C. That is, the cooling segment 530*d* in FIG. 5D is composed of a bundle of fibers including straight fibers and crimped fibers, and thus, a contact time and a contact area between the aerosol and the bundle of fibers may be increased, thereby improving a cooling efficiency, compared with the cooling segment 530*a* of FIG. 5A.

Figure 5A:
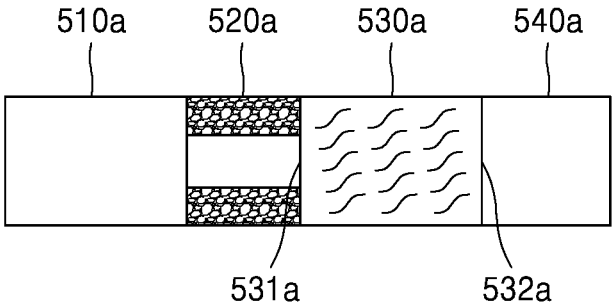
FIGS. 5A to 5D are views illustrating a temperature for each portion of a cooling segment according to an embodiment.
Figure 5B:
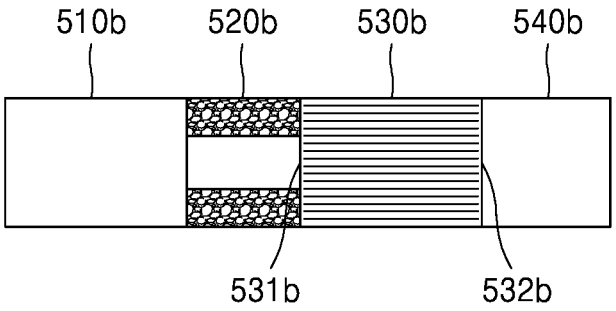
Figure 5C:
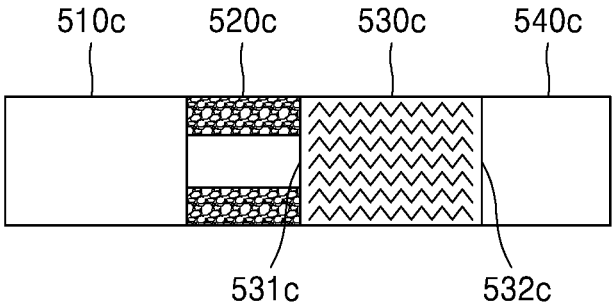
Figure 5D:
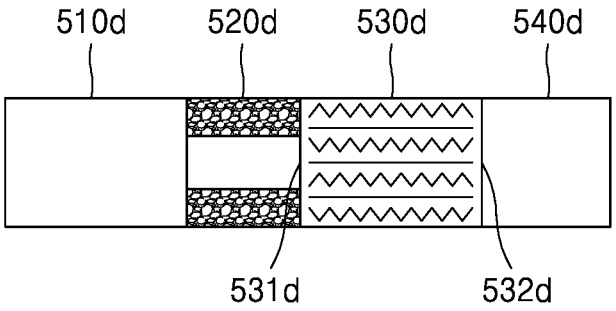

The cooling segments 530*b* to 530*d* illustrated in FIGS. 5B to 5D may include a bundle of straight fibers arranged along a longitudinal direction of a cigarette, a bundle of crimped fibers arranged along the longitudinal direction of the cigarette, or a combination thereof. As the cooling segments 530*b* to 530*d* have porosity of 50% or less, a contact time and a contact area between an aerosol and a bundle of fibers may be increased. As such, a cooling efficiency of the cooling segments 530*b* to 530*d* may be increased. In addition, as the cooling segments 530*b* to 530*d* having porosity of 50% or less may provide appropriate draw resistance, it is possible to prevent user's puff failure due to low draw resistance of the cigarette.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is represented in the claims rather than the foregoing description, and all differences within an equivalent range thereof should be interpreted as being included in the present disclosure.

What is claimed is:

1. A cigarette comprising:

a tobacco rod;

a supporting segment positioned at a downstream end of the tobacco rod;

a cooling segment positioned at a downstream end of the supporting segment; and a mouthpiece positioned at a downstream end of the cooling segment, wherein the cooling segment includes a plurality of air channels formed along a longitudinal direction of the cigarette, and porosity of the cooling segment is less than 50%, wherein the cooling segment includes a bundle of fibers arranged along the longitudinal direction of the cigarette, thereby forming the plurality of air channels, and wherein the bundle of fibers comprises at least one sub-bundle of fibers which include straight fibers of a polymer material arranged along the longitudinal direction of the cigarette; or the bundle of fibers comprises at least one sub-bundle of fibers which include crimped fibers of a polymer material arranged along the longitudinal direction of the cigarette; or the bundle of fibers is comprised of fibers made of a polymer material and includes at least one sub-bundle of straight fibers arranged along the longitudinal direction and at least one sub-bundle of crimped fibers arranged along the longitudinal direction.

2. The cigarette of claim 1, wherein the cooling segment is wrapped by a wrapper having a basis weight of 60 $g/m^2$ or more.

3. The cigarette of claim 1, wherein the cooling segment is made through a extrusion method or a textile weaving method.

4. The cigarette of claim 1, wherein the cooling segment is coated with a flavoring liquid.

5. The cigarette of claim 1, wherein the crimped fibers are crimped at a constant interval or at an irregular interval.

6. The cigarette of claim 1, wherein a length of the cooling segment is 5 mm to 30 mm.

7. The cigarette of claim 1, wherein the tobacco rod is made of sheet, strands or tobacco fragments obtained by finely cutting a tobacco sheet.

* * * * *